US006697019B1

(12) United States Patent
Hyuk-Joon et al.

(10) Patent No.: US 6,697,019 B1
(45) Date of Patent: Feb. 24, 2004

(54) LOW-PROFILE DUAL-ANTENNA SYSTEM

(75) Inventors: Kwon Hyuk-Joon, Sung Nam (KR); Iouri Sinelnikov, Seoul (KR)

(73) Assignee: Kiryung Electronics Co., Ltd., Seoul (KR)

( * ) Notice: Subject to any disclaimer, the term of this patent is extended or adjusted under 35 U.S.C. 154(b) by 0 days.

(21) Appl. No.: 10/242,800

(22) Filed: Sep. 13, 2002

(51) Int. Cl.[7] ..... H01Q 1/38; H01Q 21/00

(52) U.S. Cl. ..... 343/700 MS; 343/725; 343/729

(58) Field of Search ..... 343/700 MS, 725, 343/729, 846, 713, 711; H01Q 1/38, 21/00, 1/00

(56) References Cited

U.S. PATENT DOCUMENTS 5,523,761 A * 6/1996 Gildea ..... 342/357
6,150,984 A * 11/2000 Suguro et al. ..... 343/702
6,329,954 B1 * 12/2001 Fuchs et al. ..... 343/725
6,522,301 B2 * 2/2003 Takayama et al. ..... 343/709

* cited by examiner

*Primary Examiner*—Hoanganh Le
(74) *Attorney, Agent, or Firm*—Dykema Gossett PLLC

(57) ABSTRACT

A dual-antenna system for receiving signals transmitted via satellite and by terrestrial stations within a single broadcasting service. The dual-antenna system comprises a multi-layer printed circuit substrate as a mounting plate and a satellite antenna including a patch antenna array which has four microstrip patch antenna radiating elements provided on a top surface of the first backgrounded dielectric substrate mounted on the top face of a multi-layer printed circuit substrate, a second dielectric superstrate covering the top face of the first backgrounded dielectric substrate with the dielectric constant higher than that of the first dielectric substrate, and a low-profile radome having top and bottom sections that join together for waterproofingly housing the multi-layer printed circuit substrate assembly and antenna elements therein. The satellite patch antenna radiating elements arranged by two crossed couples which are connected to satellite antenna outputs through an active balanced feeder network with signal amplification.

4 Claims, 8 Drawing Sheets

LOW-PROFILE DUAL-ANTENNA SYSTEM

BACKGROUND OF THE INVENTION

1. Field of the Invention

The present invention relates to antenna systems for a dual-transmission single broadcasting service and more particularly to dual-antenna systems for vehicles for receiving both satellite and terrestrial transmission signals.

2. Description of the Related Art

A variety of dual-transmitter broadcasting formats are under development and service. Two of such formats those identified by the trademark SIRIUS RADIO and the trademark XM RADIO. Both satellite and terrestrial transmitters transmit the signal simultaneously. The satellite can cover the vast area, however, it can't cover all areas the area out of satellite coverage such as building blocking place. The terrestrial transmissions in urban areas will complement satellite transmission. For such applications antennas are required to receive the dual-transmission signals.

Generally, the antennas adapted for use with a vehicle is capable of receiving only the linearly polarized signals from terrestrial transmitters. Consequently, vehicle antenna must be complicated and augmented for the reception of signals from both the satellite transmitter with the circular polarization and from terrestrial transmitter with linear (usually vertical) polarization.

U.S. Pat. No. 6,329,954 issued to Andreas on Dec. 11, 2001, discloses a dual-antenna system, appropriate for automotive applications, which is capable of receiving both satellite transmission signals and terrestrial transmission signals. The antenna system is adapted to be mounted on the roof of the vehicle. The antenna system includes a radome, a satellite cross dipole antenna, a terrestrial monopole antenna elements, and a printed circuit board with feeder systems and low noise amplifiers (LNA) circuitry. The terrestrial antenna radiation pattern needs to have maximum gain for a low elevation angle, from 5 degrees up to 20 degrees and using vertical polarization. In the case of satellite antenna, the elevation angle must be typically in the order of 60±25 degree, and circular polarization (left-hand or right-hand) must be used. In either case, the radiation pattern must be omni-directional in azimuth.

However, due to a poor satellite link budget, the satellite antenna needs to be able to work on signal level less than −120 dBW. The antenna passive gain at 60 degree elevation angle must be more than +3 dBic with CP axial ratio <0.5 dB and LNA noise figure specified at level 0.6–0.9 dB. Therefore, feeder insertion loss between antenna active (radiating) elements and LNA input extremely important for the satellite antenna system performance.

U.S. Pat. No. 5,317,327 issued to Philippe on May 31, 1994, discloses a skirt-helix assembly, in which the terrestrial signals received by the skirt antenna and a satellite signal received by the helix antenna, two signals are combined in a coupler with adequate isolation between its two input channels. To increase the level of the satellite signal and to compensate for the insertion loss, an amplifier must be provided in the helical antenna circuit on the input side of the coupler. U.S. Pat. No. 6,150,984 issued to Akihiro, et al. on Nov. 21, 2000, discloses a composite shared antenna for both satellite communications and terrestrial communications and proposes a patch-shaped radiating element with connection to a linear antenna or a single-line helical antenna.

However, the antenna systems of prior art are non-planar system so not suitable for a low cost surface mount mass production assembly technology. Another problem of prior art is that most antenna structures are so bulky and large profile that the size of the antenna may become a critical point for the rooftop mount vehicle application.

As another significant disadvantage for prior art is the frequency wideband response for the cross dipole, helical, and monopole radiating antenna elements causing an interference problems with wireless networks and different spectrum radio communication signals.

SUMMARY OF THE INVENTION

The object of the present invention is to provide a dual-antenna system overcoming the problems mentioned above, which can be implemented on a Satellite Digital Audio Radio Service (SDARS) for the vehicle and other mobile and portable applications.

It is another object of the present invention to provide a low profile and compact dual-antenna system suitable for the surface mount mass production assembly technology with the improved out-of-band signal rejection, cross polarization purity, and the maximally possible sensitivity.

The antenna system is capable of receiving both satellite transmission signals and terrestrial transmission signals. The antenna system includes a first antenna for receiving circular polarized satellite transmissions and a second antenna for receiving linear polarized terrestrial transmissions. The terrestrial antenna is an array of radiating elements arranged in a symmetrical configuration with respect to the satellite antenna. Satellite antenna is also array antenna. It is circularly polarized 2×2 array of linearly polarized single feed patch elements with angular and phase arrangement, which generates a circularly polarized beam The present invention provides the antenna structure comprising a mounting substrate, having opposing top and bottom faces. On the top face are mounted a first backgrounded dielectric substrate having a circularly polarized 2×2 patch array as a satellite antenna radiating element. A second dielectric superstrate covers the first dielectric substrate with satellite antenna elements. The superstrate has a high dielectric constant.

The terrestrial antenna in array elements are mounted on a top face of mounting substrate and arranged in a symmetrical configuration around the first dielectric substrate having a satellite antenna radiating elements. The terrestrial antenna includes four linearly polarized radiating elements arranged in an array with a conical beam radiation pattern. Each antenna element has a quarter lambda grounded microstrip resonator—the surface mounted planar inverted F-antenna.

The satellite and terrestrial antennas radiating element arrays are concentric—the physical center of the each antenna array being same.

Electronic module with circuitry for signal amplification and filtering is mounted on a mounting substrate bottom face. A radome covered a mounting substrate with surface-mount antennas and electronic module. A radome has a bottom housing section and a top housing section, which are integrally joined together to hold weatherproof an antenna assembly therein.

A mounting substrate is a multi-layer printed circuit board with a planar feed networks having a first feed element's layer for the satellite antenna and a second feed element's layer for the terrestrial antenna.

A satellite antenna radiating element is an 2×2 patch array antenna having four microstrip patch antenna elements that a linearly polarized. Patch elements arranged by two crossed couples as balanced doublets. The patch feed-point phase arrangement has sequence of 0, 180, 90, 270 degrees.

The patch feed-points have a balanced active (with gain) feeding to satellite antenna outputs (to receiver) with a good rejection to common mode signal received by patches. A common mode signal means non-differential (non- 0/180 or 90/270 degree) patch excitation. Therefore, significantly improved antenna performance will be for cross-polarization rejections, especially for the low angle elevation signals.

One of the novel features of the present invention is the elimination of insertion loss brought by a conventional feeder system (passive feed network for phase arrangement) placed between the LNA input and radiating patch feed-points. Significantly improved the satellite signal/noise ratio by virtue of in-antenna signal amplification on the radiating (receiving) patch array side, so-called "active" antenna.

The patch antenna elements are printed on a back-grounded dielectric substrate located on the top face of the mounting substrate. A superstrate covers the satellite antenna elements. The superstrate has a high dielectric constant, which reduces the physical size of a wavelength of electromagnetic wave at the design frequency so that the size of the antenna elements can be reduced.

The superstrate also suppresses the cross-polarization generated by higher-order modes within the patches and this improves axial ratio at low angles for signal from low elevation satellite.

Another advantage, over the conventional ceramic patch antenna is much less patch resonance frequency sensitivity to the ceramic material dielectric constant tolerance, hence lowering production cost.

Another advantage with the present invention is that the patch antenna has a narrow bandwidth, compared to prior art antennas, more suitable for SDARS applications, for prevent out of band radio interference.

The proposed dual-antenna system structure is suitable for the conventional surface mount mass-production assembly technology.

Still another advantage is that the present invention has a low built-in antenna height compared to prior art antennas. The proposed antenna improves the cosmetic appearance of the vehicle with SDARS.

These and other objects, advantages, and features of the invention will be more readily understood and appreciated by reference to the detailed description of the preferred embodiment and the drawings.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Preferred embodiments of the present invention will now be described with reference to the accompanying drawings.

Figure 1:
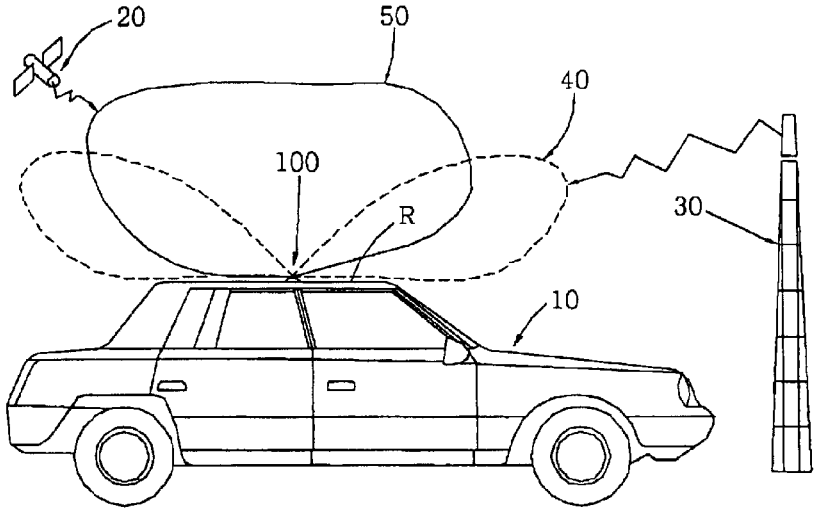
FIG. 1 illustrates an exemplary Satellite Digital Audio Radio Service.

Referring to FIG. 1, a dual-antenna system 100 is conventionally installed on the automobile roof 10 to receive the dual—transmission signals from both satellite transmitter 20 and terrestrial transmitter 30 in a Satellite Digital Audio Radio Service (SDARS) environment. Both types of transmitters operate in the same frequency band. The radiation pattern of satellite antenna is indicated as 50 and the radiation pattern of the terrestrial antenna is indicated as 40.

Figure 2:
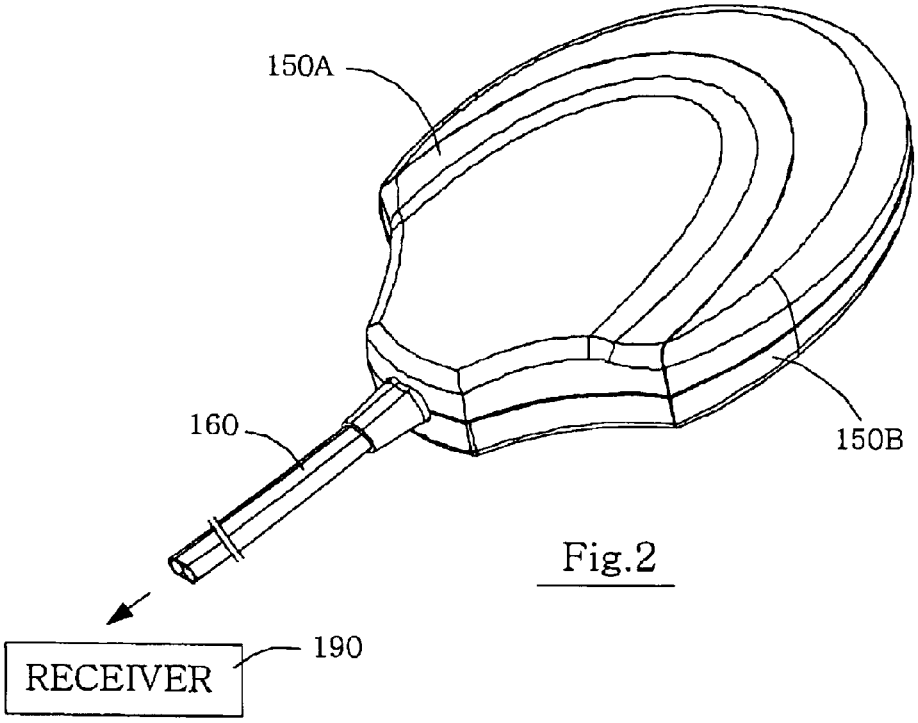
FIG. 2 is a perspective view of the dual antenna system of the present invention with output cable.
Figure 3:
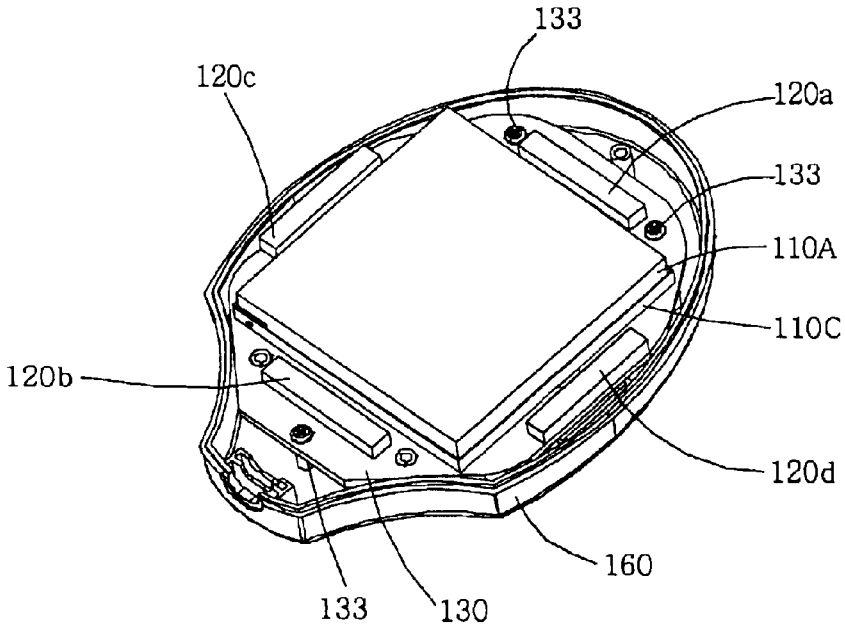
FIG. 3 is a perspective view of the dual antenna system with the radome removed.
Figure 4:
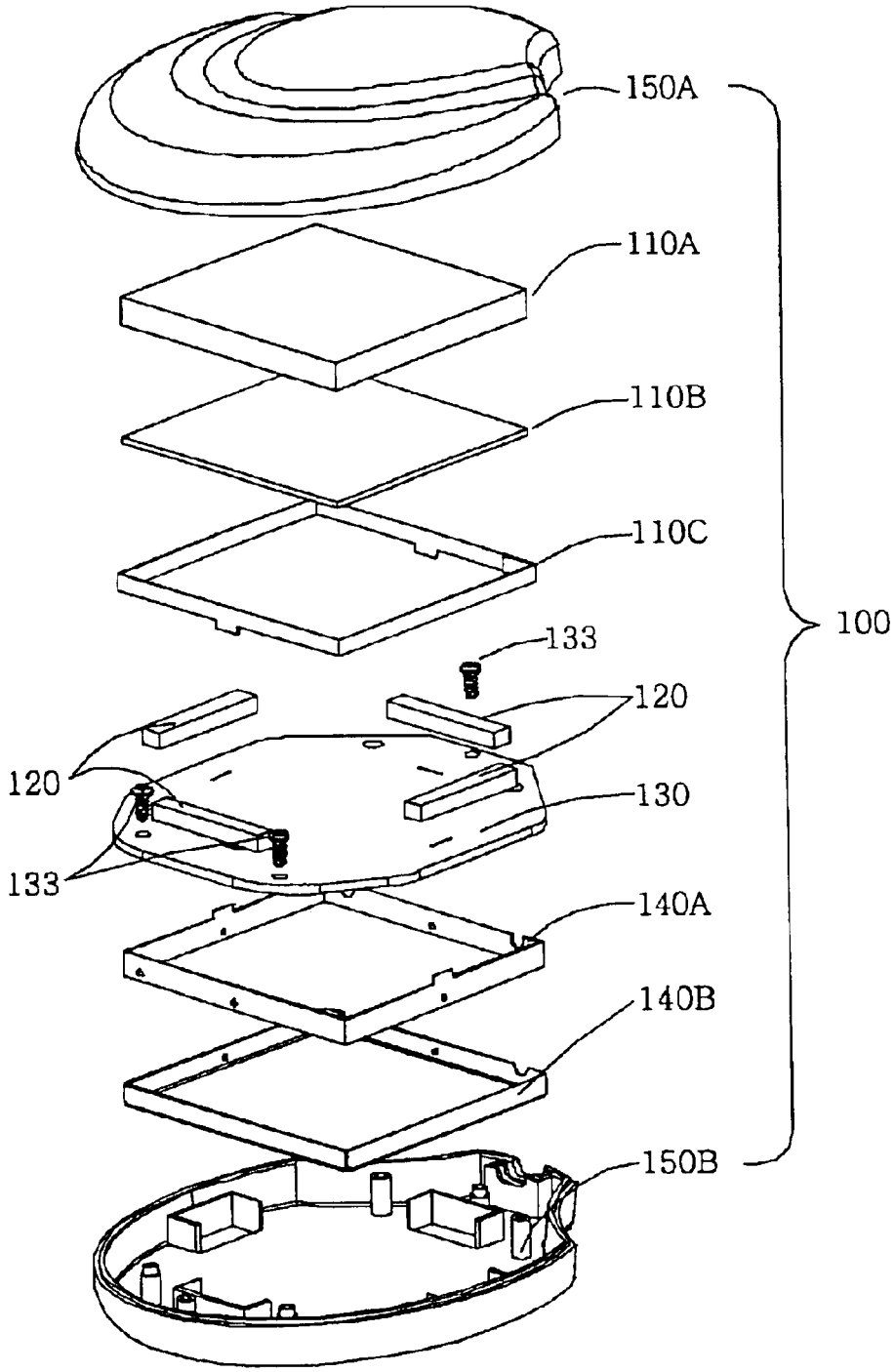
FIG. 4 is an exploded perspective view of the dual antenna system

A shown in FIGS. 2–4, the dual antenna system 100 according to the present invention includes a satellite antenna 110 and a terrestrial antenna 120 which are mounted on a multi-layer printed circuit board 130 as a mounting plate and a radome 150 having a bottom housing section 150B and a top housing section 150A which are integrated by means of for example ultrasonic welding technique to protect the sensitive antenna system units therein in all weathers. The terrestrial antenna 120 includes four terrestrial antennas radiating elements 120*a, b, c, d*. The multi-layer printed circuit board 130 may be mounted by screw 133 inside the radome 150. In FIG. 2, the signals from the dual-antenna system are transmitted to a receiver 190 through the coaxial cable 160.

The multi-layer printed circuit board 130 is provided with a planar feed networks having a first feed element's layer for the satellite antenna feeder and a second feed element's layer for the terrestrial antenna feeder. Although not shown in FIGS. 2 and 3, two electronics LNA modules with circuitry for signal amplification and filtering (See FIG. 2 of the U.S. Pat. No. 6,329,954) are conventionally mounted on a bottom face of mounting substrate 130 and shielded by the metal cavities 140A and B.

Figure 5:
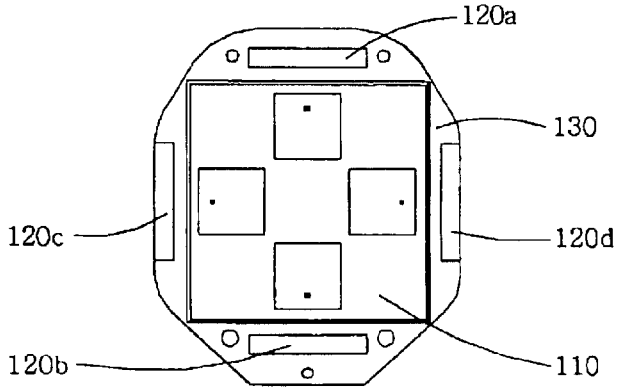
FIG. 5 is a schematic plan view showing the arrangement of the satellite and terrestrial antenna radiating elements mounted on a multi-layer printed circuit substrate.

FIG. 5 shows the arrangement of the satellite antenna 10 and terrestrial antenna radiating elements 120*a, b, c, d* of the terrestrial antenna 120 in which four terrestrial antenna radiating elements 120*a, b, c, d* are arranged by a symmetrical configuration with respect to the satellite antenna 110. Two satellite and terrestrial antennas are concentric—the physical center of the each antenna array being same. The symmetrical spacing of the satellite and terrestrial antennas with respect to each other provides the antenna isolation and improved performance as cross polarization purity.

Figure 6:
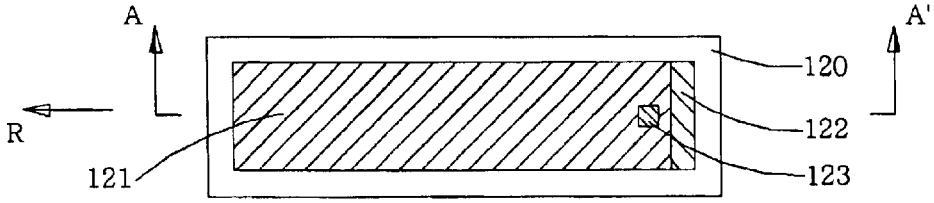
FIG. 6 is an enlarged plan view of the terrestrial antenna radiating elements.
Figure 7:
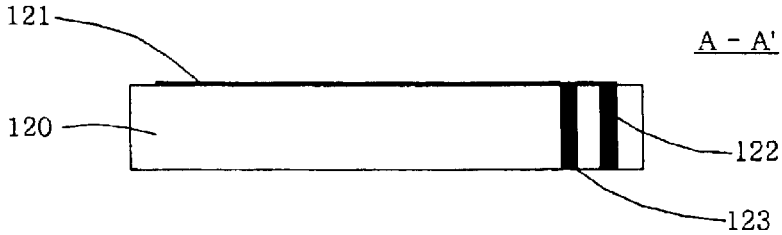
FIG. 7 is a cross sectional view taken along the line A—A' in FIG. 6

FIGS. 6 and 7 schematically illustrate the structure of the terrestrial radiating element. Each terrestrial antenna element 120*a,b, c, d* have dielectric brick shape. Each terrestrial antenna element 120*a, b, c, d* as a quarter lambda microstrip resonator 121 on a top side with a feed-point 123 and is grounded through via a grounding conductor 122. This kind of microstrip antenna is so called surface mounted planar inverted F-antenna. "Inverted F-antennas" are known from T. Taga and K. Tsunekawa, "Performance Analysis of a Built-in Planar Inverted F Antenna for 800 MHz Band Portable Radio Units," IEEE Trans. Selected Areas in Common., vol. SAC-5, no.5, pp. 921–929, June (1987). The terrestrial antenna elements are matched by varying the positions of the feed-point 123. Inverted F-antennas have a narrow band (≦5%Fo) frequency response and is capable of receiving only linearly (vertical) polarized signals from open microstrip resonator side, on direction R, as illustrated FIG. 6.

Figure 8:
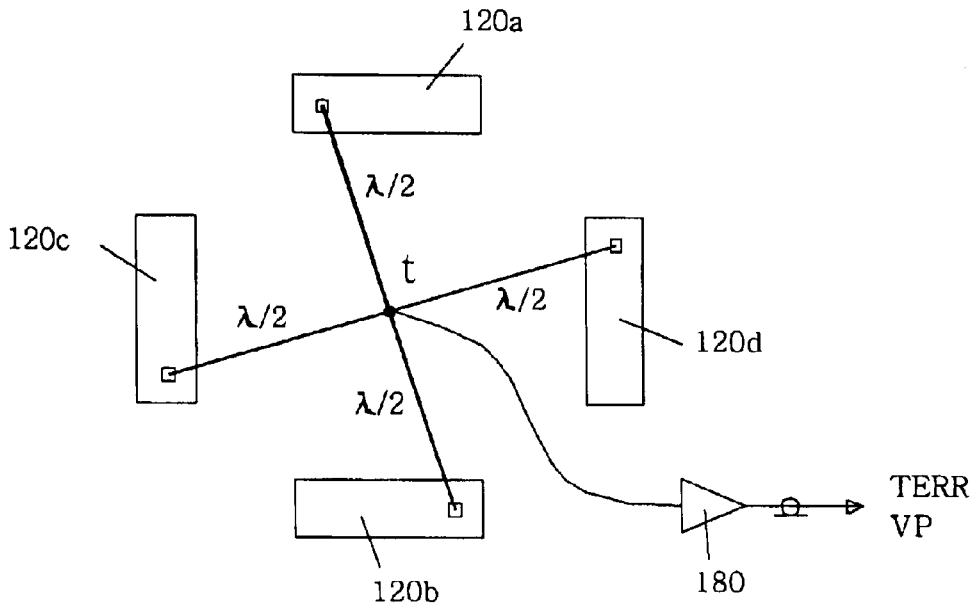
FIG. 8 is a schematic block diagram of the terrestrial antenna with a feeder system and LNA circuitry.

FIG. 8 illustrates the terrestrial antenna arrays with feeder system for producing conical beam radiation pattern 40. Feed-points 123 on the radiating elements 120*a, b, c, d* are connected to common point "t" through the terrestrial antenna feeder—half lambda strip line sections which are located as inner layers of multi-layer printed circuit board 130.

LNA 180 provides amplification for the terrestrial linearly vertical polarized signals. For standard 50-Ohm impedance matching with LNA input radiating elements 120*a, b, c, d* should be with 200-Ohm output impedance. That value (or any other, for example preferred for LNA input noise matching) can be obtained by proper positioning of feed-point 123 across the quarter lambda microstrip resonator 121.

Figure 9:
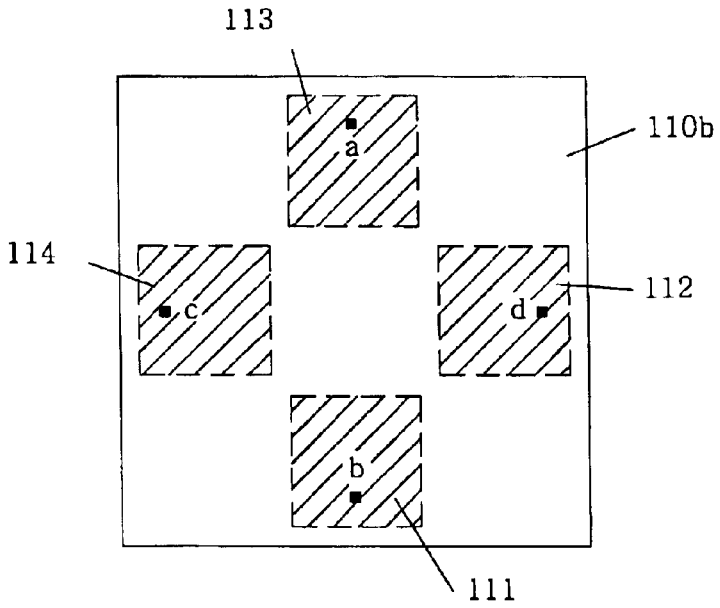
FIG. 9 is an enlarged schematic plan view showing the arrangement of the satellite antenna radiating elements.

FIG. 9 shows the satellite antenna unit 110 having a first backgrounded dielectric substrate 110B in which four microstrip patch antenna radiating elements 111–114 are formed on the top side The microstrip patches are linearly polarized radiating elements 111–114, which are arranged in circularly polarized 2×2 array with angular and phase arrangement. That is, the patch antenna radiating elements 111–114 with feed-points "a, b, c, d" are arranged by two crossed couples as balanced doublets 114/112 and 111/113 of which feed points c/d and b/a phase arrangement has sequence 0/180 degree and 90/270 degree, respectively, so that a circularly polarized beam 50 is generated.

The same arrays, so called a sequential array is described in "Handbook of Microstrip Antennas" by J. R James, P. S. Hall, and C. Wood, appearing in IEE Electromagnetic Waves Series, No. 12, published by P. Perigrinus Ltd., Stevanage, UK, page 759.

However, the solution proposed in the present invention makes patches symmetrically disposed on opposite sides as balanced doublets 114/112 and 111/113. That symmetrical spatial diversity provides balanced array with improved antenna cross-polarization performance.

The patch antenna elements may be formed by circuit-printing techniques on a backgrounded dielectric substrate 110B located on the top face of a mounting substrate 130. A superstrate 110A covers the satellite antenna radiating elements. The superstrate has a high dielectric constant, which reduces the physical size of a wavelength of electromagnetic wave at the design frequency so that the size of the antenna elements can be reduced. As well known from prior art (U.S. Pat. No. 6,246,369 and another publications) a superstrate loading effects improve the circular polarization axial ratio and cross polarization characteristics of a patch array antenna.

Figure 10:
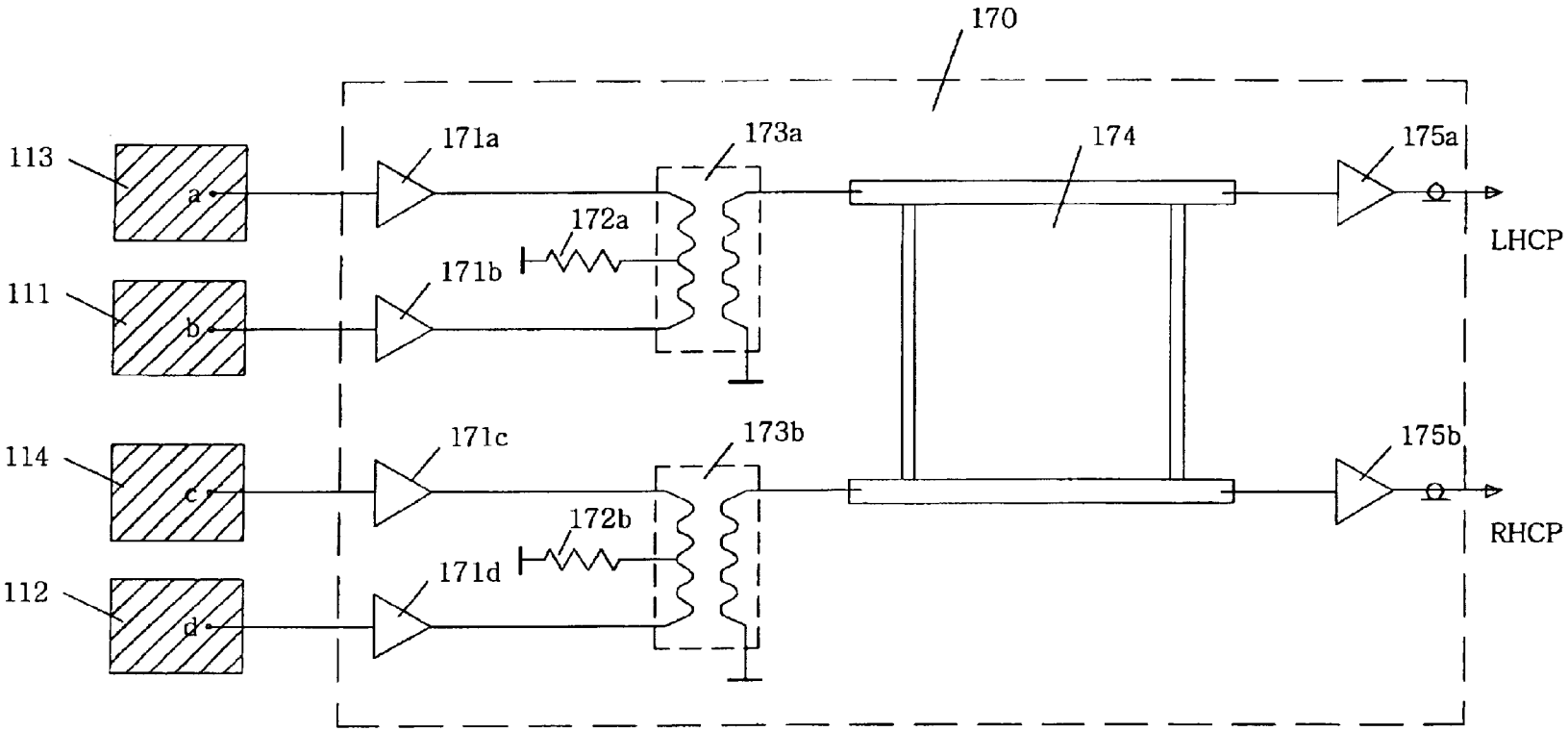
FIG. 10 is a schematic block diagram of the satellite antenna with balanced active coupling network (feed system) and LNA circuitry.

FIG. 10 illustrates an active balanced feeder network to a balanced satellite antenna patches array. One of the novel features of the present invention is the elimination of insertion loss brought by a conventional feeder system (passive power divider with phase arrangement) placed between LNA 175 input and radiating patch feed points (a, b, c, d).

Schematically as illustrated in FIG. 10, a pre-amplifiers 171*a, b, c, d* and discrete balun transformer 173*a,b* and 90 degree branch-line coupler 174 are advantageously provide patch array balanced feeding with gain. Resistors 172*a, b* are used for impedance matching The satellite signal/noise ratio significantly improved by virtue of in-antenna amplification on the radiating (receiving) patch array side (so-called "active" antenna). The described structure provides simultaneous reception and division into different LNA 175*a,b* outputs of signals with the left and right hand circular polarization (LHCP, RHCP). An antenna performance improvement is obtained by setting the noise figure of the system at a pre-amplifiers stage level thereby rendering losses in the passive feed network negligible.

A second benefit from balanced patch array with a balanced active (with gain) feeding is a good rejection of undesirable common mode signal received by patches. Common mode signal means non-differential (non- 0/180 or 90/270 degree) patch excitation. So significantly improved antenna performance will be for LHCP-RHCP—linearly signals cross-polarization rejections, especially for the low angle elevation.

Figure 11:
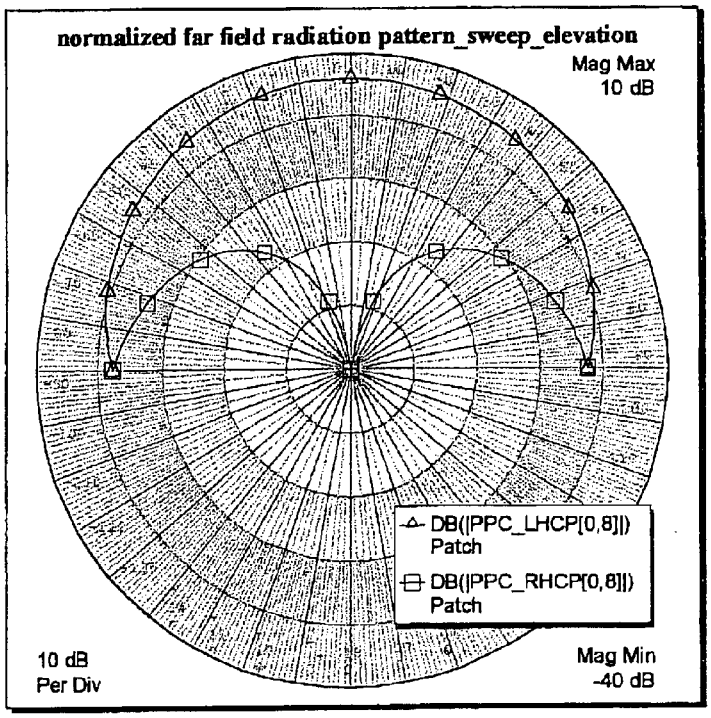
FIG. 11 is an elevation radiation pattern for the satellite antenna illustrated in FIG. 9.
Figure 12:
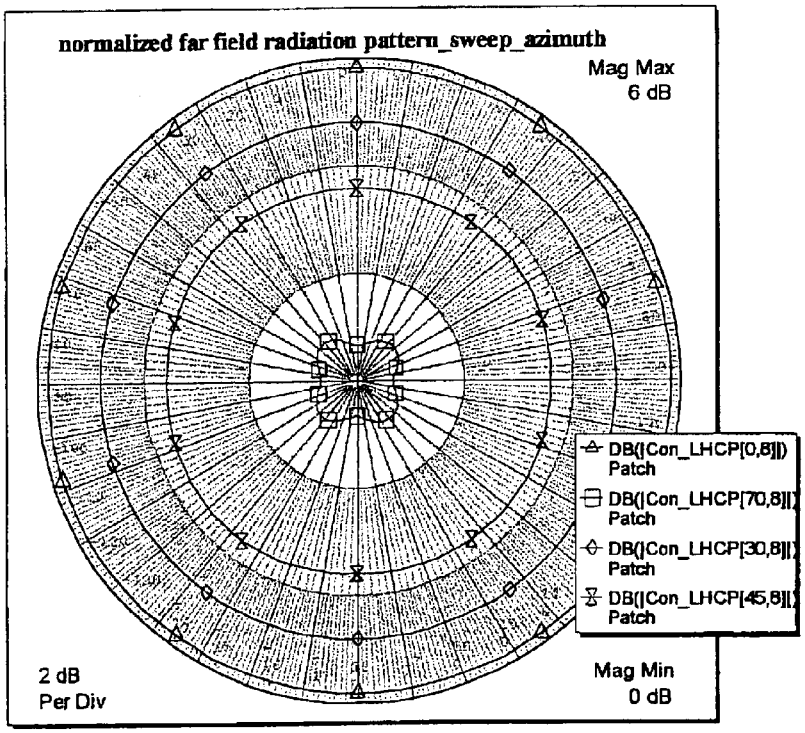
FIG. 12 is an azimuth radiation pattern for the satellite antenna illustrated in FIG. 9.

FIGS. 11 and 12 show the calculated elevation and azimuth radiation patter is for the satellite antenna system of preferred embodiment of the present invention described above.

Figure 13:
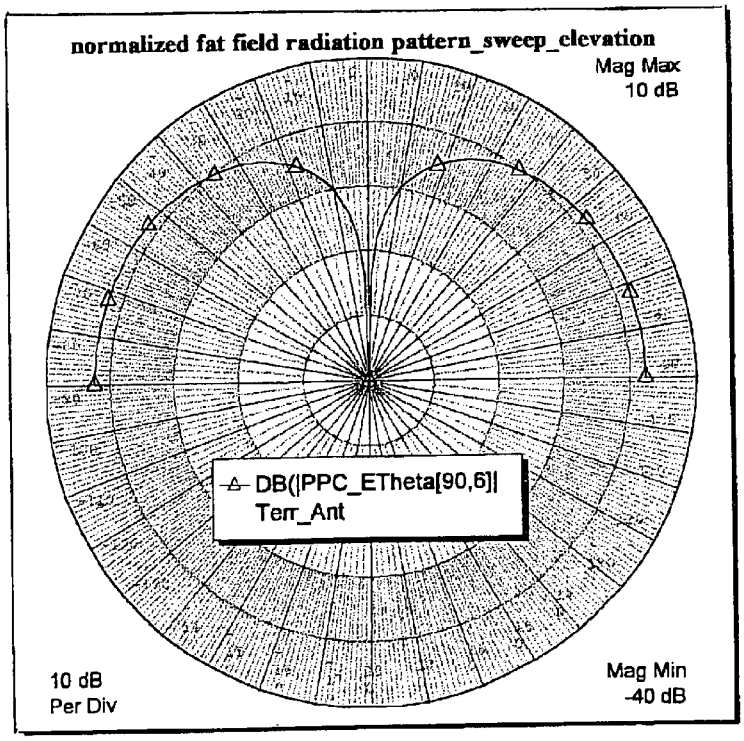
FIG. 13 is an elevation radiation pattern for the terrestrial antenna illustrated in FIG. 8
Figure 14:
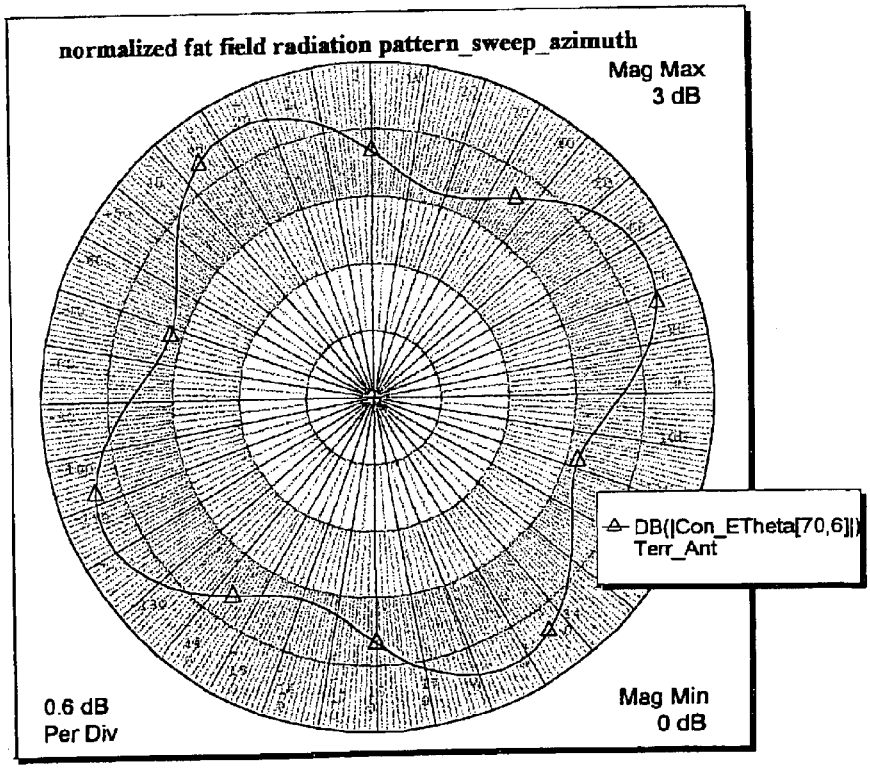
FIG. 14 is an azimuth radiation pattern for the satellite antenna illustrated in FIG. 8.

FIGS. 13 and 14 show the calculated elevation and azimuth radiation pattern is for the terrestrial antenna system of preferred embodiment of the present invention described above.

Although the invention has been described and illustrated in the above description and drawings, it is understood that this description is by example only and that numerous changes and modifications can be made by those skilled in the art without departing from the true spirit and scope of the invention. For example, different types of radiating patch antenna elements 111–114, 120 may be employed, such as a circular patch or other possible shapes. Further, the branch-line 90 degree coupler element 174 can be constructed using any kind off 90 degree quadrature hybrid coupler structures other than the branch-line coupler and so on.

What is claimed is:

1. A low-profile dual-antenna system for receiving signals transmitted via satellite and by terrestrial stations within a single broadcasting service, said antenna system comprising a multi-layer printed circuit substrate as a mounting plate;

a satellite antenna including a patch antenna array which has four microstrip patch antenna radiating elements provided on a top surface of the first backgrounded dielectric substrate mounted on the top face of said multi-layer printed circuit substrate, and a second dielectric superstrate covering the top face of said first backgrounded dielectric substrate with the dielectric constant higher than that of said first dielectric substrate;

a terrestrial antenna including a terrestrial antenna array which has a plurality of linearly polarized radiating elements mounted on said multi-layer printed circuit substrate and arranged in a symmetrical configuration around said first dielectric substrate, said patch antenna array and said terrestrial antenna array being concentric and the physical centers of each of the antenna arrays being the same; and a low-profile radome having top and bottom sections that join together for waterproofingly housing the multi-layer printed circuit substrate assembly and antenna elements therein.

2. An antenna system according to claim 1, wherein said microstrip patch antenna radiating elements arranged in a symmetrical spatial diversity by two crossed couples as the first and second balanced patch doublets which are connected to the first and second satellite antenna outputs through an active balanced feeder network with signal amplification.

3. An antenna system according to claim 2, wherein said active balanced feeder network comprises:

first and second balanced-to-unbalanced transformers (balun) placed on the bottom side of said multi-layer printed circuit substrate and having balanced input and unbalanced output; and a quadrature hybrid coupler placed in the inner layers of said multi-layer printed circuit substrate for providing said first and said second satellite antenna outputs with the left and right hand circular polarization signals and combining said first and said second balun unbalanced outputs;

a first couple of two pre-amplifiers, each having the inputs connected to said first balanced patch doublet and said pre-amplifiers outputs connected to first said balun transformer balanced side inputs; and a second couple of two pre-amplifier, each having the inputs connected to said second balanced patch doublet and said pre-amplifiers outputs connected to said second transformer balanced side inputs.

4. An antenna system according to claim 1, wherein said terrestrial antenna array radiating elements are connected to the common output through the terrestrial antenna feeder having the length for strip line sections to provide a conical beam radiation pattern for said terrestrial antenna array, said terrestrial antenna feeder strip lines located in inner layers of said multi-layer printed circuit substrate.

* * * * *